US005438385A

United States Patent [19]

Tanaka

[11] Patent Number: 5,438,385

[45] Date of Patent: Aug. 1, 1995

[54] AUTOMATED DEVELOPMENT PROCESSOR FOR DENTAL X-RAY FILM

[75] Inventor: Hiroyuki Tanaka, Yokohama, Japan

[73] Assignee: Nix Company Ltd., Tokyo, Japan

[21] Appl. No.: 288,774

[22] Filed: Aug. 11, 1994

[30] Foreign Application Priority Data

Aug. 17, 1993 [JP] Japan ..... 5-234351

[51] Int. Cl.[6] ..... G03D 13/02; G03D 13/14

[52] U.S. Cl. ..... 354/337; 354/345; 354/344

[58] Field of Search ..... 354/344–347, 354/319–321, 337; 226/90–92

[56] References Cited

U.S. PATENT DOCUMENTS 3,882,525 5/1975 Zwettler ..... 354/339

FOREIGN PATENT DOCUMENTS 53-17057 6/1978 Japan .

53-17058 6/1978 Japan .

*Primary Examiner*—D. Rutledge

*Attorney, Agent, or Firm*—Evenson, McKeown, Edwards & Lenahan

[57] ABSTRACT

When a ring with an exposed dental X-ray film mounted thereon is thrown into a first tank filled with a processing solution, the ring is scooped into a space of a ring-holding portion of a rotating arm through a first opening. As the ring-holding portion is moving in the tank, the ring is pushed by a tilted bottom portion while being held within the space by a release preventing wall and a door so that the ring is also moving together with the ring-holding portion. When the ring-holding portion has fully moved out of the tank, the door is opened and the ring is released from the space into an adjacent tank through a second opening.

9 Claims, 15 Drawing Sheets

AUTOMATED DEVELOPMENT PROCESSOR FOR DENTAL X-RAY FILM

BACKGROUND OF THE INVENTION a) Field of the Invention

This invention relates to an automated development processor for an exposed dental X-ray-film so that the exposed dental X-ray film is developed.

b) Description of the Related Art

X-ray pictures are often used for the diagnosis and treatment of teeth. Such an X-ray picture is obtained by sealing a dental X-ray film in an X-ray-transmitting but light-tight pack, taking an X-ray picture of teeth with the packed film, taking the X-ray film out of the pack in a dark room or the like and then processing it for development.

Development processors for developing X-ray films include various types. For example, the automated development processor proposed in Japanese Patent Publication No. SHO 53-17058 or the like has a compact construction so that it can be easily installed even in a private dental clinic. According to this automated development processor, an X-ray film taken out of a pack is developed by mounting the X-ray film on a ring and then causing the ring to successively move through a plurality of tanks which are each filled with a processing solution.

FIG. 1 is a plan view of the ring with the X-ray film mounted thereon, while FIG. 2 is a cross-sectional view, taken in the direction of arrows II—II of FIG. 1. In each of the drawings, there are shown the ring at letter R and a slot formed in an inner periphery of the ring R. The X-ray film which is designated at letter F is fitted in the slot G so that the X-ray film is mounted. This fitting can be readily carried out by making use of the flexibility of the X-ray film F.

The ring R is thrown into a tank and by an arm attached to a rotary shaft, is then conveyed in the tank. When the ring R reaches a predetermined location in the tank, the ring R is thrown into a next tank and is conveyed likewise by another arm in the next tank. By successively conveying the ring R through the tanks arranged adjacent to one another, the X-ray film F is processed for its development, for example, is developed and fixed, whereby an X-ray picture of teeth is obtained on the X-ray film eventually.

The above-described conventional automated development processor is constructed so that the ring R with the X-ray film F mounted thereon is transferred from one tank to a next-stage tank arranged in adjacent to the former tank. To smoothly perform this transfer without trouble, an arm which is brought into contact with the ring R to convey the ring is formed to present an aslant surface on a side of the next-stage tank. The X-ray film F is therefore conveyed in a tilted position during its conveyance through the tank, so that if the tank has been fabricated even with a slightly greater widthwise dimension in the course of the manufacture of the development processor, a substantial space is formed between an inner wall of the tank and the arm, thereby involving the potential problem that the ring R may drop onto the bottom wall of the tank. Once the ring R drops, it is impossible to directly recover the dropped X-ray film F from the bottom of the tank because the width of the tank is small. The automated development processor must be disassembled, thereby making the recovery work very cumbersome.

Further, individual arms are attached at angular intervals to different shafts in such a way that the arms can be rotated in different directions. This involves the problem of a complex structure and coupled with such a complex structure, significant labor and time are needed upon disassembly for the recovery of the dropped X-ray film F.

SUMMARY OF THE INVENTION

An object of the present invention is to provide an automated development processor for a dental X-ray film, which is free of the above-described problems of the conventional art, can avoid dropping of a ring and has a simple structure.

In one aspect of the present invention, there is thus provided an automated development processor for an exposed dental X-ray film, said processor having a plurality of tanks filled with processing solutions, respectively, and arranged in parallel with one another so that development processing of the exposed dental X-ray film is conducted by successively throwing into the tanks a ring with the exposed dental X-ray film mounted thereon, comprising:

a rotary shaft whose axis extends in the same direction as the direction of the arrangement of the individual tanks; and arms fixed, in registration with said respective tanks on said rotary shaft so that said arms are movable in the corresponding tanks;

wherein each of said arms comprises a fixed portion secured on said rotary shaft and a ring-holding portion arranged on a free end of said fixed portion, and said ring-holding portion defines a space for holding said ring therein and comprises a bottom wall for supporting said ring in said space, a first opening for receiving therethrough said ring, which is located in the corresponding processing solution, into said space as said corresponding arm is moving, a second opening for releasing said ring from said space into the adjacent tank or where said arm is associated with the last tank, releasing said ring out of said space, and means for preventing release of said ring through said second opening as said ring-holding portion is moving in the corresponding tank.

When the ring is thrown into a first tank, the ring is scooped into the space of the ring-holding portion of the rotating arm through a first opening. As the ring-holding portion is moving in the tank, the ring is pushed by the bottom portion while being held within the space by the release preventing means so that the ring is also moving together with the ring-holding portion. When the ring-holding portion has fully moved out of the tank, the discharge preventing means is inactivated so that the ring is released through a second opening from the space into the adjacent tank or where the tank is the last tank, is released out of the space.

According to the present invention, the ring with the film mounted thereon is conveyed while the ring is held in the space of the ring-holding portion. It is hence possible to prevent the ring from sinking onto the bottom of the tank in the course of its conveyance and moreover to ensure transfer of the ring to the next tank. The arms are arranged to rotate in only one direction so that the construction of the arms can been simplified.

Provision of a guide wall on each arm further ensures the transfer of the ring to the next-stage tank.

DETAILED DESCRIPTION OF THE INVENTION AND PREFERRED EMBODIMENTS

The present invention will hereinafter be described based on the embodiments illustrated in the accompanying drawings.

Figure 1:
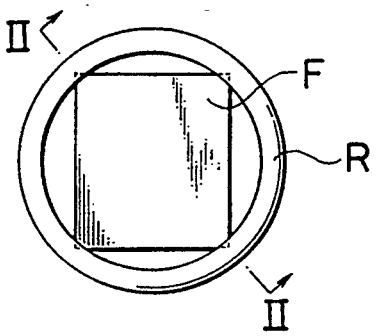
FIG. 1 is a plan view of a ring with an X-ray film mounted thereon.
Figure 2:
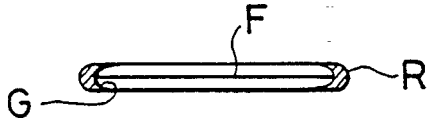
FIG. 2 is a cross-sectional view of the ring and X-ray film, taken in the direction of arrows II—II of FIG. 1.
Figure 3:
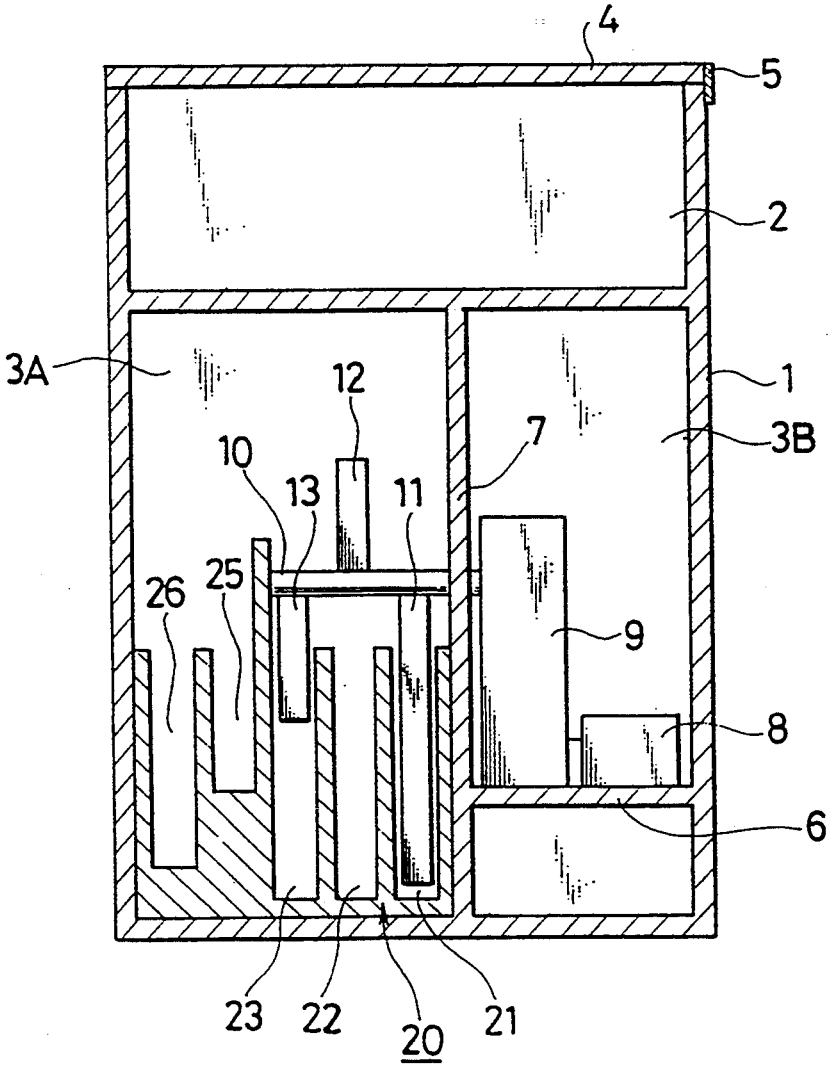
FIG. 3 is an overall construction diagram of an automated development processor for a dental X-ray film, which replates to a first embodiment of the present invention.

The automated development processor according to the first embodiment of this invention will first be described with reference to FIG. 3, which illustrates a housing 1, an upper compartment 2 formed in the housing 1, a development processing compartment 3A, a reducing mechanism compartment 3B, a lid 4 and a hinge 5 for opening or closing the lid. Also shown are a base 6, a partition 7 dividing the development processing compartment 3A and the drive mechanism compartment 3B from each other, a motor 8 mounted on the base 6, a reducing mechanism 9 constructed of gears or the like, and a rotary shaft 10 rotatable by the motor 8 via the reducing mechanism 9. Designated at numerals 11, 12 and 13 are arms secured on the rotary shaft 10. These arms 11,12,13 are all formed in the same structure with the same dimensions and are secured on the rotary shaft 10 at positions predetermined in a circumferential direction of the rotary shaft 10.

Designated at numeral 20 is a tank unit, which is formed of a tank 21 filled with a developer and tanks 22,23 filled with a fixer. Although the individual tanks 21,22,23 are formed as an integral unit in the illustrated embodiment, they can be formed as discrete members. The tank 21 and the arm 11 are positioned opposite to each other, so the tank 22 and the arm 12, and also the tank 23 and the arm 13. The dimension between inner walls of each tank (namely, the width of each tank) and the width of its associated arm are selected so that the latter becomes slightly smaller than the former. Numerals 25,26 are discharge passages through which a ring R already subjected to processing for development is discharged. In the drawing, these discharge passages are formed integrally with the tank unit 20. Incidentally, the rotary shaft 10 is mounted between the partition 7 and an extension of a wall of the tank 23, said wall being located on a side of the discharge passage 25.

Figure 4:
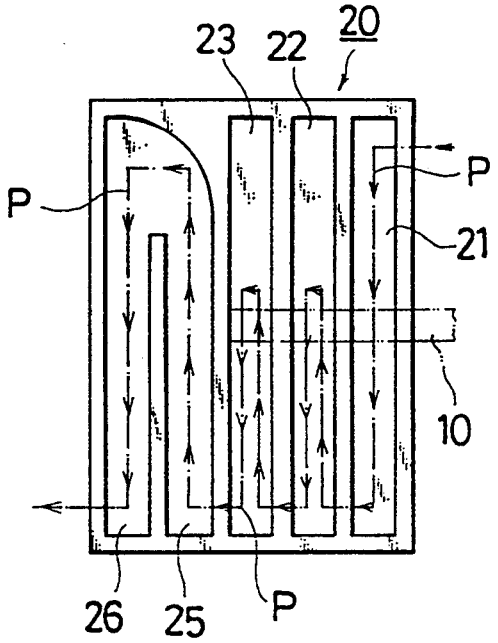
FIG. 4 is a plan view of tanks shown as a unit in FIG. 3.

FIG. 4 illustrates the tank unit 20 and the discharge passages 25,26 in plan. In this drawing, elements identical to their corresponding elements in FIG. 3 are identified by like reference numerals. The tanks 21,22,23 and the discharge passages 25,26 have a narrow shape. As is indicated by arrows on an alternate long and short dash line P in the drawing, the ring R with an X-ray film F fitted thereon is first thrown into the tank 21 at one end of the tank and conveyed by the arm 11 through the tank 21, is next thrown into the tank 22, allowed to sink onto a bottom of the tank and then conveyed in the same state by the arm 12 through the tank 22, is thereafter thrown into the tank 23, allowed to sink onto a bottom of the tank and then conveyed by the arm 13 through the tank 23, and is finally discharged into the discharge passage 25 and then allowed to roll down on the tilted bottom walls of the discharge passage and the subsequent discharge passage 26 to an outlet port (not shown).

The tank 21 will be described with reference to FIG. 5. As is illustrated, each side wall of the tank 21 is formed in a substantially semicircular shape. At a top, the tank is formed in an elongated rectangular shape which has a width W and a length L far longer compared with the width W. Designated at letter H is a heater pad arranged on an outer wall of the tank 21, whereby a processing solution in the tank 21 can be maintained at a predetermined temperature. The remaining tanks 22,23 have the same construction as the tank 21 so that their illustration and description are omitted herein.

Figure 6:
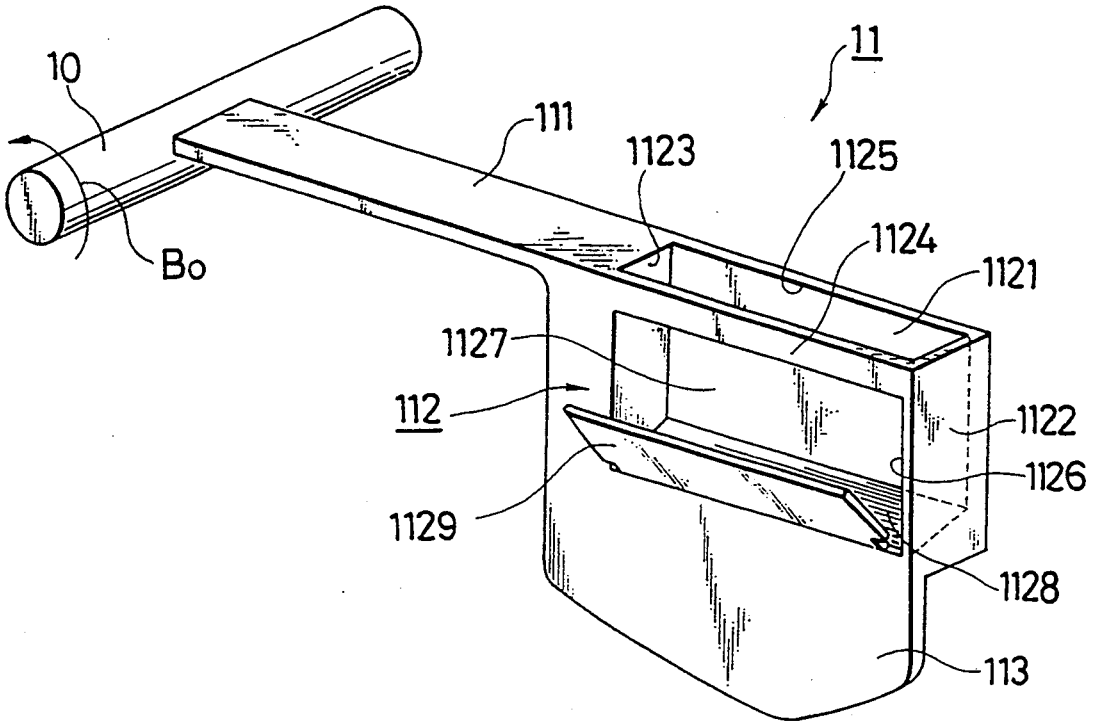
FIG. 6 is a perspective view of one of arms illustrated in FIG. 3.

A description will next be made of the structure of the arm 11. As the remaining arms 12,13 have the same structure as the arm 11, the structure of the arm 11 alone will be described and description of the structures of the remaining arms 12,13 is omitted herein. FIG. 6 depicts the arm in perspective. The arm 11 is constructed of a plate-shaped fixed portion 111 secured on the rotary shaft 10, a ring-holding portion 112 formed as an integral member at a free end portion of the fixed portion 111, and a guide wall 113 also formed as an integral member with the fixed portion 111. The guide wall 113 is formed thinner than the widths of the fixed portion 111 and the ring-holding portion 112, and the position of its arrangement is rear relative to the direction of movement of the ring-holding portion and as is shown in the drawing, is flush relative to a wall of the ring-holding portion 112, said wall being on a side of the adjacent tank 22. The direction of rotation of the rotary shaft 10 is indicated by arrow $B_0$.

The ring-holding portion 112 has a rear wall 1121, opposing side walls 1122,1123, a tilted bottom wall 1128 and a space 1127 surrounded by these walls. A first opening 1125 is defined in a face opposing the tilted bottom wall 1128 (i.e., in an upper face as viewed in the drawing) whereas a second opening 1126 is defined in a face opposing a front face opposing the rear wall 1121. Numeral 1124 indicates a release preventing wall formed in an upper part of the second opening 1126 and defining a front edge of the first opening 1125. Designated at numeral 1129 is a door which opens or closes a lower part of the second opening 1126. Detailed constructions of these openings will be described subsequently herein.

Figure 7:
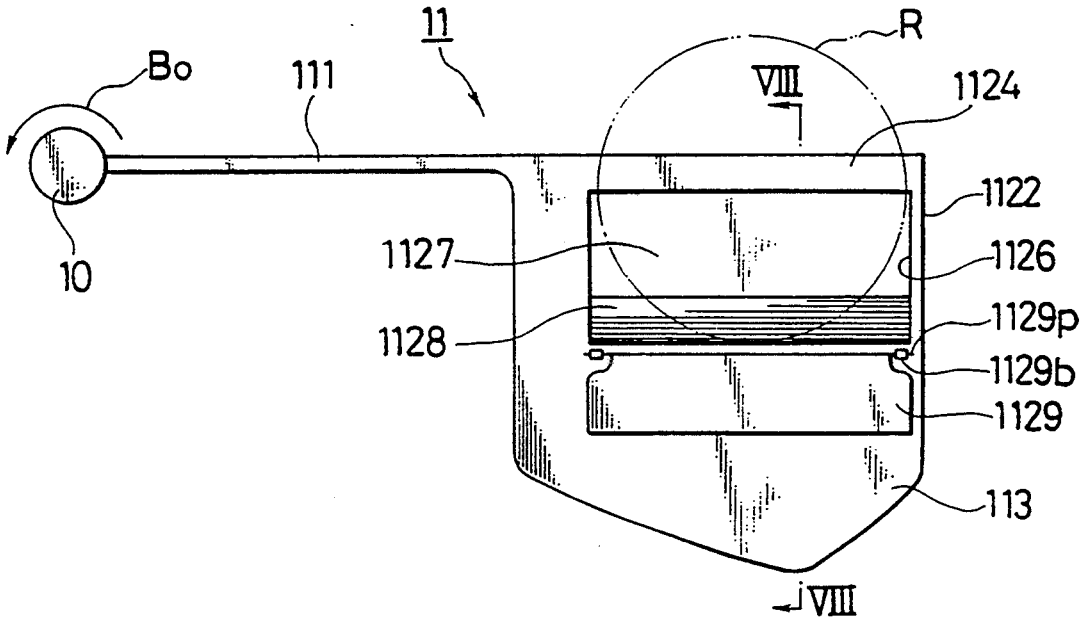
FIG. 7 is a front view of the arm depicted in FIG. 6.
Figure 8:
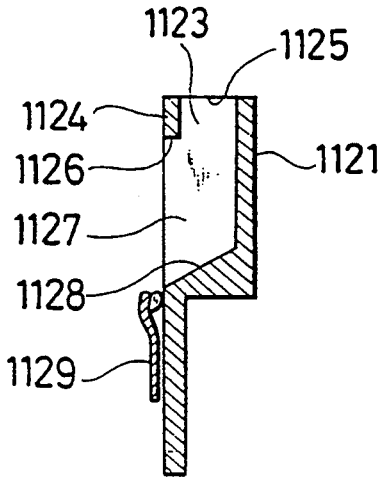
FIG. 8 is a cross-sectional view taken in the direction of arrows VIII—VIII of FIG. 7.

The arm 11 will be described with reference to FIGS. 7 and 8. In these drawings, elements identical to the corresponding elements shown in FIG. 6 are identified by like reference numerals. Numeral **1129*p* indicates pins integrally with the door 1129, while numeral 1129*b* designates bearings which turnably support the opposite pins 1129*p*, respectively. In FIG. 7, the ring R received in the space 1127 of the ring-holding portion 112** is indicated by a phantom.

The door 1129 will next be described with reference to FIG. 9. Numeral **1129*p* indicates the same pin as that shown in FIG. 5. An offset a is formed between a center of the pin 1129*p* (the center of turning motion of the door 1129) and the door 1129 as shown in the drawing. Owing to this offset a, the door 1129 is biased by gravity to fall in the direction indicated by arrow A when the arm 11 is in the position shown in FIG. 5 and the door 1129 is in the position indicated by a phantom in FIG. 9, that is, in the position where the door closes the lower part of the second opening 1126**.

Figure 9:
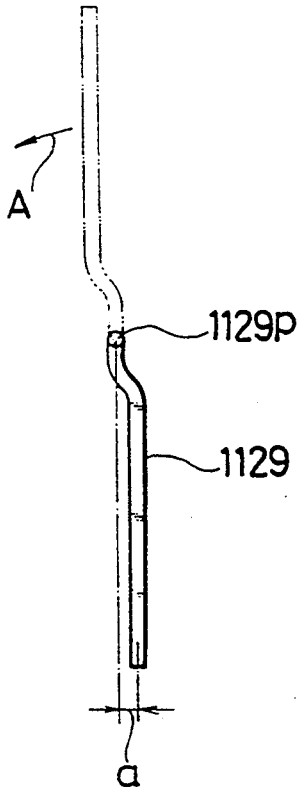
FIG. 9 is a side view of a door shown in FIG. 7.
Figure 10:
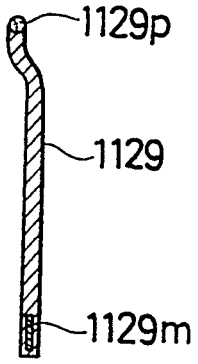
FIG. 10 is a cross-sectional view of a modification of the door shown in FIG. 7.

The modification of the door 1129 will now be described with reference to FIG. 10, in which elements identical to the corresponding elements in FIG. 9 are designated by the same reference numerals. A metal **1129*m* is embedded or otherwise attached to a free end portion of the door 1129. By the metal, the biasing in the direction indicated by arrow A in FIG. 9** is ensured further.

Figure 11:
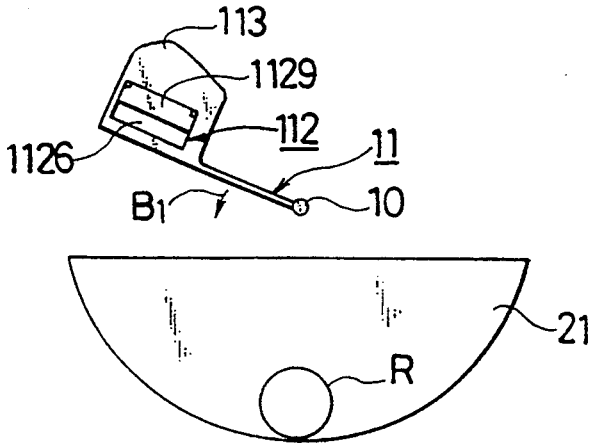
FIG. 11 is a schematic illustration of operation of the automated development processor shown in FIG. 3.

Operation of the automated development processor according to this embodiment will next be described with reference to FIG. 11 to FIG. 15. FIG. 11 to FIG. 15 schematically illustrate relationships between the ring-holding portion 112 and the ring R in various positions of the arm 11. As is illustrated in FIG. 11, when the ring R is thrown into the tank 21, the ring R sinks to a lowermost part in the tank 21 and becomes standstill there. When the arm 11 progressively turns in the direction of arrow $B_1$, the door 1129 closes by its own weight a part (a lower part as viewed in FIG. 7 or an upper part as viewed in FIG. 11) of the second opening 1126 at a position turned past its upright position as depicted in FIG. 11.

Figure 12:
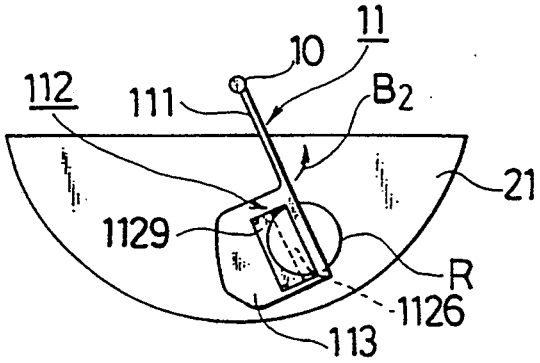
FIG. 12 is a schematic illustration of operation of the automated development processor shown in FIG. 3.

As the arm 11 turns further, the arm 11 enters the tank 21 together with the ring-holding portion 112. The door 1129 poses no problem on this entrance as the door has been closed by that time. As the arm 11 moves through the tank 21, the ring-holding portion 112 eventually reaches the position where the ring R is sunk. As the arm 11 moves further, the ring R is scooped into the space 1127 through the first opening 1125 of the ring-holding portion 112 as illustrated in FIG. 12 (see FIG. 6). As the arm 11 turns further in this state in the direction of arrow $B_2$, the tilted bottom wall 1128 of the ring-holding portion 112 (see FIGS. 6 and 7) moves while pushing the ring R. During this movement, the ring R slides down on and along the aslant surface of the tilted bottom wall 1128 and pushes out the door 1129. The door 1129 is however pressed against the inner wall of the tank 21 so that the door is not opened.

Figure 13:
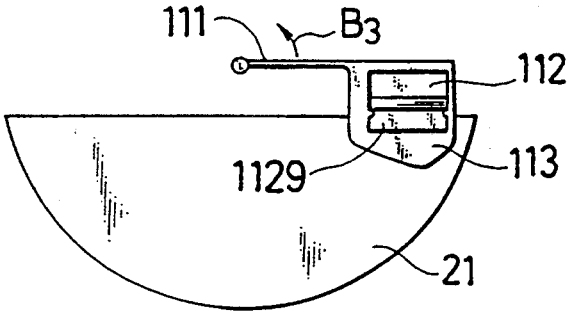
FIG. 13 is a schematic illustration of operation of the automated development processor shown in FIG. 3.

As the arm 11 continues to turn in the direction of arrow $B_2$, the ring-holding portion 112 eventually moves away from an upper edge of the tank 21 so that the door 1129 becomes no longer in contact with the inner wall of the tank 21. By the gravity-dependent biasing force in the direction of arrow A described in FIGS. 9 and 10 and the pressing force of the ring R, the door 1129 is opened so that the ring R slides down on and along the tilted bottom wall 1128 toward the next-stage tank 22. The state after the ring R has slid down into the tank 22 is shown in FIG. 13.

Figure 14:
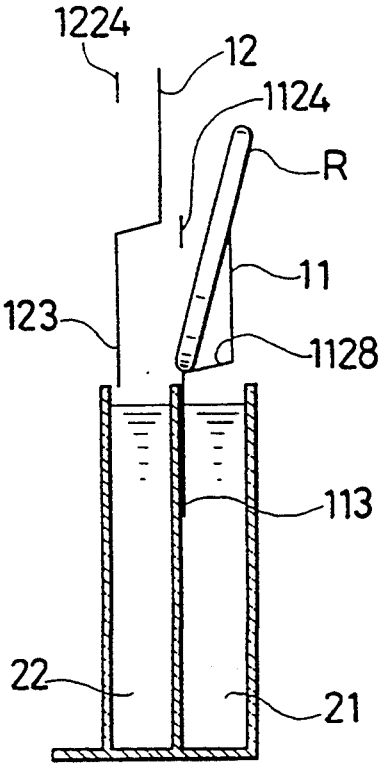
FIG. 14 is a schematic illustration of operation of the automated development processor shown in FIG. 3.

The state immediately before the sliding-down of the ring R into the tank 22 is illustrated in FIG. 14. Elements identical to the corresponding elements shown in FIGS. 3 and 6 are identified by like reference numerals. Numeral 1224 indicates a release preventing wall of the ring-holding portion of the arm 12, while numeral 123 designates a guide wall of the arm 12. When the ring R is about to drop into the tank 22, there is the potential problem that by its own power, the ring R may jumps over the tank 22 and may plunge into the next tank 23. If the turning motion of the adjacent arm 12 is adjusted so that the guide wall 123 of the arm 12 assumes the position indicated in FIG. 14 when the ring R drops, the jumping-over of the ring R is however blocked by the guide wall 123 and the ring R is allowed to surely drop into the tank 22.

Figure 15:
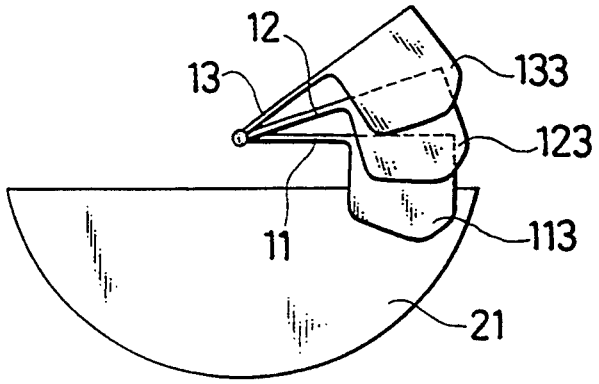
FIG. 15 is a schematic illustration of operation of the automated development processor shown in FIG. 3.

It is desired that the relationship between dropping of the ring R and the position of the guide wall 123 exists in exactly the same manner between the ring R and the guide wall of the arm 13 as the ring R is transferred from the tank 22 to the tank 23. Such a relationship can be adjusted in view of properties of the developer and fixer, a revolution speed of the rotary shaft, dimensions of the guide wall, etc. FIG. 15 illustrates a positional relationship among the guide walls 113,123,133 of the individual arms 11,12,13 after such an adjustment has been effected. In this drawing, development processing is conducted in the order that after a ring R is transferred from the tank 22 to the tank 23, another ring R is transferred from the tank 21 to the tank 22.

Since each arm is provided with the ring-holding portion and each ring is held in the space of the ring-holding portion while the ring is moving through the corresponding tank, the ring is prevented from becoming out of contact with the arm and dropping into the tank or being caught between one of the side walls of the tank and the arm. Further, the individual arms are fixed on the common rotary shaft so that they rotate in one direction. The structure can be simplified. Moreover, each arm is provided with the guide wall so that transfer of each ring to the tank of the next stage can be achieved without failure.

Figure 16:
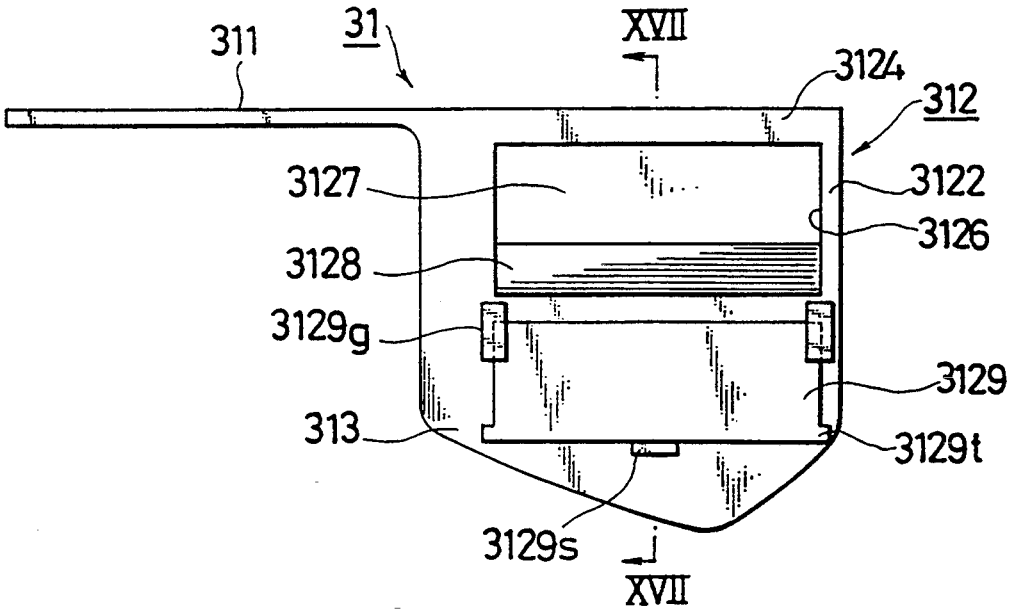
FIG. 16 is a front view of an arm in an automated development processor according to a second embodiment of the present invention.
Figure 17:
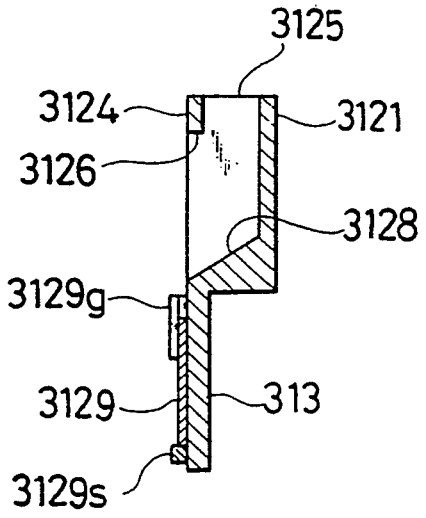
FIG. 17 is a cross-sectional view taken in the direction of arrows XVII—XVII of FIG. 16.

Referring next to FIGS. 16 and 17, the automated development processor according to the second embodiment of the present invention will be described. In each of these drawings, there are illustrated an arm 31 corresponding to the arm 11 in the above-described first embodiment, a fixed portion 311, a ring-holding portion 312 formed as an integral member at a free end portion of the fixed portion 311, and a guide plate 313 constructed integrally with the fixed portion 311. Like the guide wall in the above-described first embodiment, the guide wall 313 is formed thinner than the widths of the fixed portion 311 and the ring-holding portion 312, and the position of its arrangement is rear relative to the direction of movement of the ring-holding portion 312 and as is shown in the drawings, is flush relative to a wall of the ring-holding portion 112, said wall being on a side of the adjacent tank 22.

The ring-holding portion 312 has a rear wall 3121, opposing side walls 3122,3123 (not shown), a tilted bottom wall 3128 and a space 3127 surrounded by these walls. A first opening 3125 is defined in a top face opposing the tilted bottom wall 3128 whereas a second opening 3126 is defined in a front face opposing the rear wall 3121. Numeral 3124 indicates a release preventing wall formed in an upper part of the second opening 3126 and defining a front edge of the first opening 3125. Designated at numeral 3129 is a slide door which opens or closes a lower part of the second opening 3126. There are also shown lugs **3129*t* formed on opposite sides of a lower part of the slide plate 3129, a stopper 3129*s* for preventing any further downward movement of the slide plate 3129, and guides 3129*g* for guiding sliding movement of the slide plate 3129. The guides are engageable with the lugs 3129*t* to prevent any further upward movement of the slide plate 3129**.

As is apparent from the construction described above, the second embodiment is structurally different from the first embodiment only in that the slide plate 3129 is used in place of the door 1129. The remaining construction is the same as that of the first embodiment. Accordingly, the second embodiment operates in the same manner as the first embodiment except for operation of the slide plate 3129.

When the arm 31 is in the position shown in FIG. 11, the slide plate 3129 slides toward the second opening 3126 so that the slide plate closes the second opening 3126 with the lugs **3129*t* held in contact with the corresponding guides 3129*g*. In this state, the ring R is scooped into the space 3127 within the tank 21 as in the case shown in FIG. 12, and the arm 31 then continues its turning motion. As the arm 31 moves upwards, the slide plate 3129 is caused to slide down and is brought into contact with the stopper 3129*s* in the course of the upward movement of the arm. The second opening 3126 is therefore fully opened and when the arm assumes the position shown in FIG. 13, the ring R slides down into the tank 22**.

Incidentally, the slide plate 3129 slides down to open the second opening 3126 a little before the arm assumes the position shown in FIG. 13. The ring R inside the ring-holding portion 312 is however prevented from sliding down by the release preventing wall 3124 and the inner wall of the tank.

Advantages of the second embodiment are the same as those of the first embodiment described above.

Figure 18:
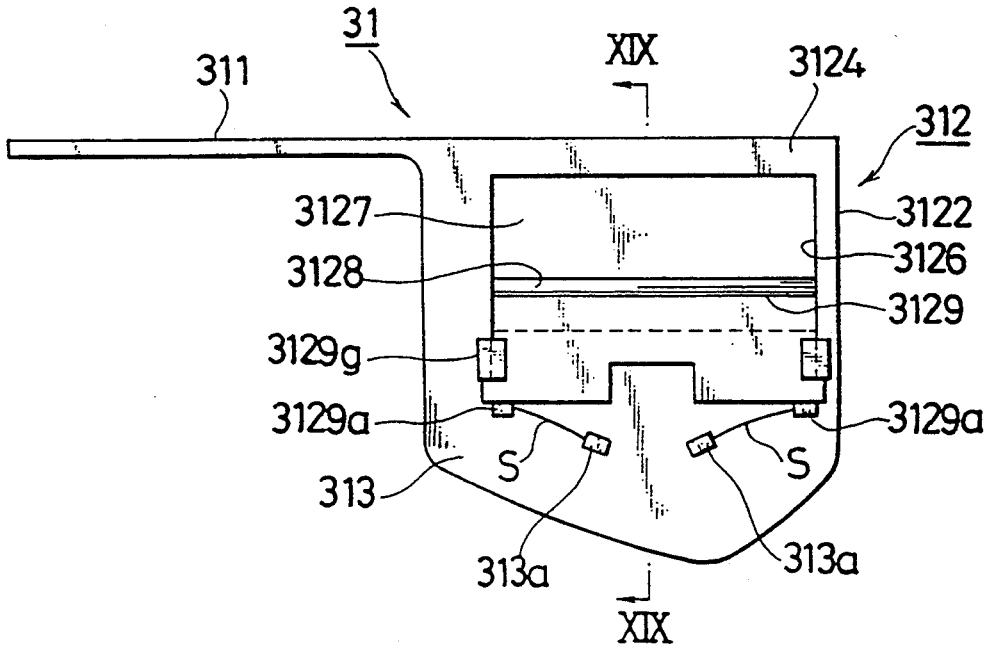
FIG. 18 is a front view of a modification of the arm in the second embodiment.

Referring next to FIG. 18, a description will be made of the modification of the arm 31, which modification makes use of a slide plate 3129 similar to that illustrated in FIG. 16. In the drawing, elements identical or equivalent to the corresponding elements shown in FIG. 16 are identified by like reference numerals. There are illustrated spring clasps **3129*a* secured on a lower end of the slide plate 3129, slide clasps secured on a guide plate 313 at predetermined locations, and springs S disposed between the corresponding spring clasps 312*a*,313*a*. The slide plate 3129 is normally biased upwards by the springs S so that the slide plate covers a lower part of a second opening 3126. Selected as the spring force of the springs S is a relatively weak spring force which is sufficient only to keep the slide plate 3129** at a raised position against its own weight.

Figure 19:
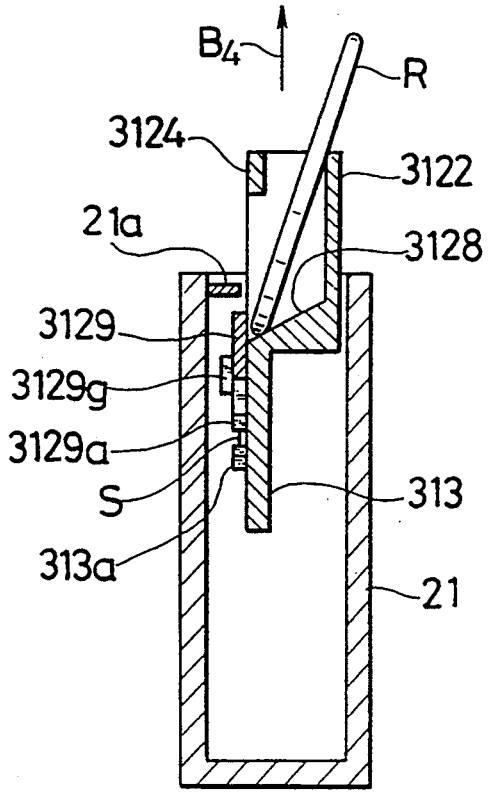
FIG. 19 is a cross-sectional view illustrating operation of the arm shown in FIG. 18.

Operation of the modification shown in FIG. 18 will next be described with reference to FIG. 19. Illustrated in FIG. 19 are the arm 31 and the tank 21 immediately before the arm 31 takes the position depicted in FIG. 13. The section of the arm 31 is the section taken in the direction of arrows XIX—XIX of FIG. 18. In FIG. 19, elements identical to the corresponding elements in FIG. 18 are identified by like reference numerals. Designated at numeral **21*a* is an engaging piece, which is formed of a leaf spring arranged slightly below an upper end of an inner wall of the tank 21. The spring force of this engaging piece 21*a*** is set at a value substantially greater than the combined spring force of both the springs S.

When the ring-holding portion 312 of the arm 31, with the ring R internally held therein (at this time, the slide plate 3129 covers the lower part of the second opening 3126 by the spring forces of the springs S), moves in the direction of arrow $B_4$ to the position indicated in FIG. 19 and further in the direction of arrow $B_4$, the upper end of the slide plate 3129 comes into engagement with the engaging piece **21*a*. When the movement in the direction of arrow $B_4$ continues further in this state, the slide plate 3129 is pressed down against the combined force of the springs S owing to the difference in spring force between the springs S and the engaging piece 21*a* so that the second opening 3126 is fully opened. As a consequence, the ring R is thrown into the tank 22** of the next stage.

When the ring-holding portion 312 moves further in the direction of arrow $B_4$ as a result of turning of the arm 31, the lower end of the slide plate 3129 comes into contact with the spring clasps **313*a* so that the downward sliding movement of the slide plate 3129 stops. When the movement in the direction of arrow $B_4$ continues further, the slide plate 3129 moves past the position of the engaging piece 21a while elastically deforming the engaging piece 21*a* and sliding on the same. After that, the slide plate 3129 slides upwardly by the spring forces of the springs S and immediately returns to its home position. Further, the engaging piece 21a also returns to its original shape. When the arm 31 turns further and assumes the position shown in FIG. 12, the slide plate 3129 covers the lower part of the second opening 3126 so that the ring R is surely held in the ring-holding portion 312**.

An arm equipped with such a slide plate further ensures holding of the ring R than the arm illustrated in FIG. 16.

In each of the above-described first and second embodiments and modification, the door or slide plate covering the second opening through which the ring is released may be constructed to cover the second opening in its entirety.

Figure 20:
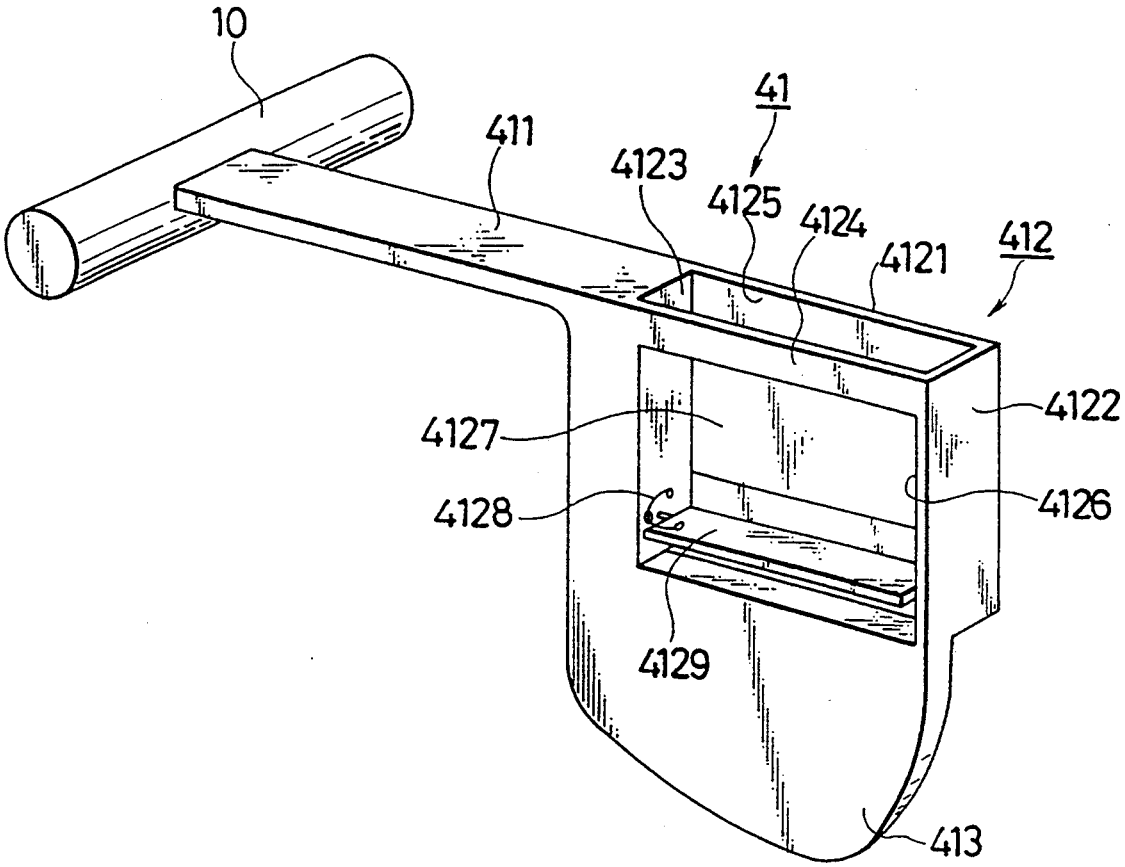
FIG. 20 is a perspective view of an arm in an automated development processor according to a third embodiment of the present invention.

Referring next to FIG. 20, the arm in the automated development processor according to the third embodiment of the present invention will be described. Other arms corresponding to other tanks have the same structure as the arm depicted in FIG. 20. Designated at numeral 41 is the arm in the third embodiment. The arm 41 is constructed of a plate-shaped fixed portion 411 secured on the rotary shaft 10, a ring-holding portion 412 formed as an integral member at a free end portion of the fixed portion 411, and a guide wall 413 also formed as an integral member with the fixed portion 411. The guide wall 413 is formed thinner than the widths of the fixed portion 411 and the ring-holding portion 412, and the position of its arrangement is rear relative to the direction of movement of the ring-holding portion 412 and as is shown in the drawing, is flush relative to a wall of the ring-holding portion 412, said wall being on a side of the adjacent tank 22.

The ring-holding portion 412 has a rear wall 4121, opposing side walls 4122,4123, a tilted bottom wall 4129 and a space 4127 surrounded by these walls. A first opening 4125 is defined in a top face opposing the tilted bottom wall 4129 whereas a second opening 4126 is defined in a front face opposing the rear wall 4121. Numeral 4124 indicates a release preventing wall formed in an upper part of the second opening 4126. Designated at numeral 4128 is a spring arranged between the side wall 4123 and the tilted bottom wall 4129.

Figure 21:
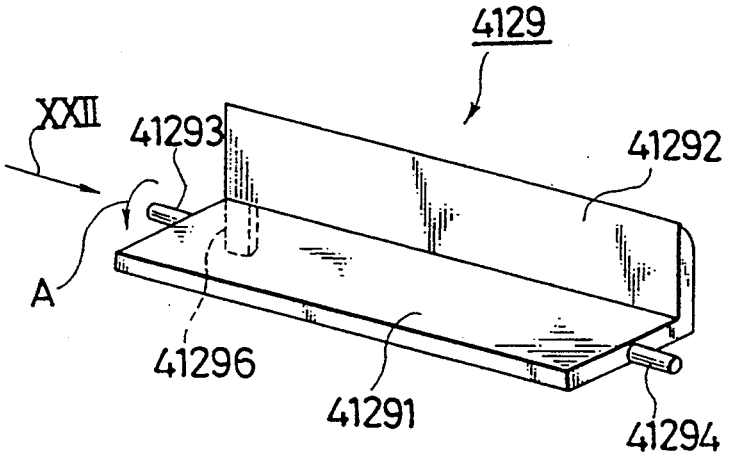
FIG. 21 is a perspective view of a tilted bottom portion shown in FIG. 20.

In FIG. 21, the tilted bottom portion 4129 is depicted in perspective. The tilted bottom portion 4129 is constructed of a turnable portion 41291, a wall 41292 integral with and perpendicular to the turnable portion 41291, pins 41293,41294 extending out from the turnable portion 41291, and an engaging piece 41296. The pin 41293 is turnably attached to the side wall 4123 whereas the pin 41294 is turnably attached to the side wall 4122. The spring 4128 shown in FIG. 20 is arranged to make the turnable portion 4129 turn in the direction of arrow A shown in FIG. 21. The engaging piece 41296 extends out from the turnable portion 41291 downwardly as viewed in the drawing.

Figure 22:
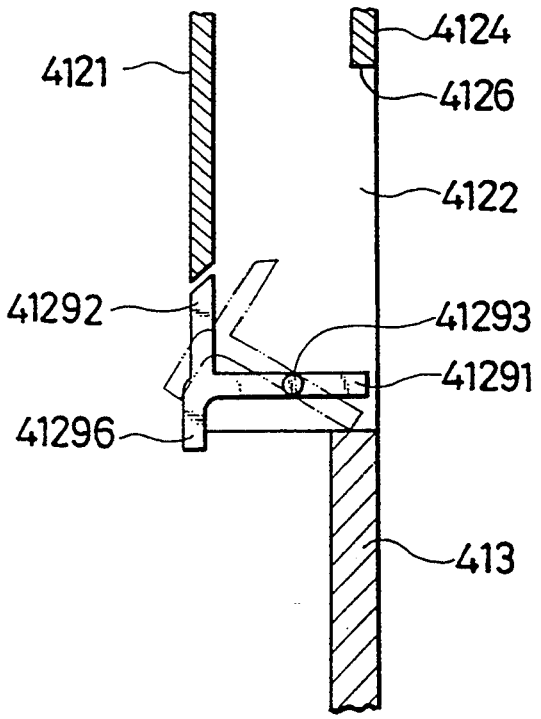
FIG. 22 is a side view of the tilted bottom portion as viewed in the direction of arrow XXII of FIG. 21.

FIG. 22 is the side view, of the tilted portion 4129 mounted on the ring-holding portion 412, as viewed in the direction of arrow XXII in FIG. 21. Some parts of the ring-holding portion 412 is shown in cross-section. In FIG. 22, elements identical to the corresponding elements in FIGS. 20 and 21 are identified by like reference numerals. With the tilted portion 4129 mounted, the vertical wall 41292 is substantially flush relative to the rear wall 4121. While the turnable portion 41291 is not restrained at all from the outside, the tilted portion 4129 assumes such as position as indicated by alternate long and short dash lines because of the spring 4128, so that the engaging piece 41296 projects out from the plane of the rear wall 4121.

Figure 23:
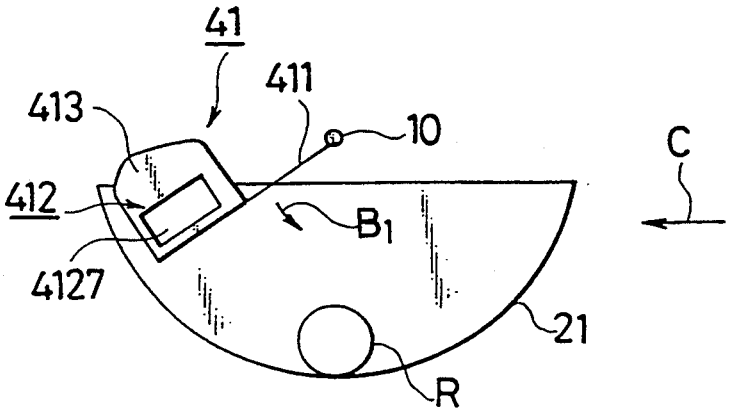
FIG. 23 is a schematic illustration of operation in which the arm depicted in FIG. 20 is used.
Figure 24:
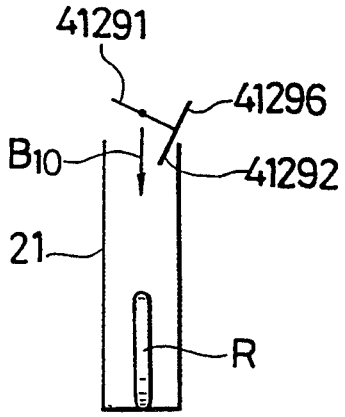
FIG. 24 is a schematic illustration of operation in which the arm depicted in FIG. 20 is used.
Figure 25:
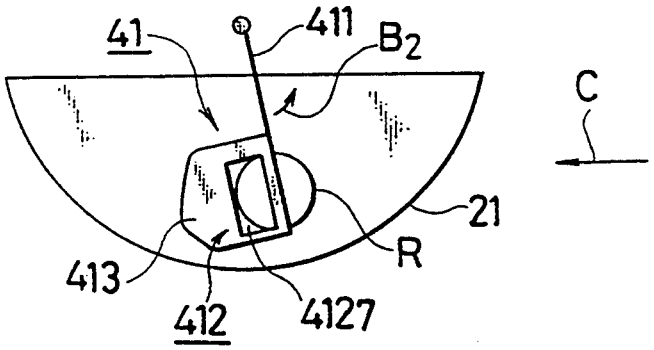
FIG. 25 is a schematic illustration of operation in which the arm depicted in FIG. 20 is used.
Figure 26:
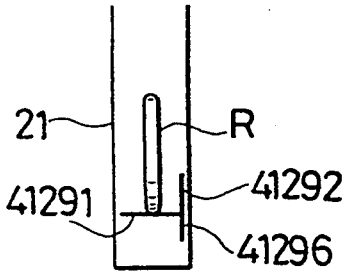
FIG. 26 is a schematic illustration of operation in which the arm depicted in FIG. 20 is used.

Next, operation of the arm in the third embodiment will be described with reference to FIG. 23 through FIG. 28. These drawings schematically illustrate relationships between the ring-holding portion 412 and the ring R in various positions of the arm 41. Further, FIGS. 24, 26 and 28 show the positions of the tiled portion as viewed in the direction of arrow C in FIGS. 23, 25 and 27, respectively. As is illustrated in FIG. 23, when the ring R is thrown into the tank 21, the ring R sinks to a deepest part in the tank 21 and settles there. While the arm 41 is moving in a space above the tank 21, the tilted portion 4129 is free from restraint so that the tilted portion 4129 assumes the position shown in FIG. 24, that is, the turnable portion 41291 is tilted and the engaging piece 41296 is located at an upper position and projects out of the side wall of the tank 21.

As the arm 41 turns from this state in the direction of arrow $B_1$ shown in FIG. 23, the tilted portion 4129 moves downwardly as indicated by arrow $B_{10}$. Eventually, the engaging piece 41296 projecting out from the outer surface of the rear wall 4121 comes into engagement with the upper edge of the tank 21. Further turning of the arm 41 causes the engaging piece 41296 to engage the inner wall of the tank 21 so that the engaging piece 41296 is pushed by the inner wall of the tank 21. This causes the turnable portion 41291 to turn against the biasing force of the spring 4128 as illustrated by solid lines in FIG. 22, whereby the turnable portion 41291 lies in a plane substantially perpendicular to the inner wall of the tank 21 as depicted in FIG. 26.

As the arm 41 turns further in the direction $B_2$, the arm 41 moves together with the ring-holding portion 412 inside the tank 21 and eventually reaches the position where by ring R is sunk. Further movement of the arm 41 results in scooping of the ring R into the space 4127 through the first opening 4125 of the ring-holding portion 412 (see FIG. 20). When the arm 41 moves further in this state, the ring-holding portion 412 moves while pushing the ring R by its turnable portion 41291. During this movement, the turnable portion 41291 presents a planar surface which is not tilted. Owing to the existence of this planar surface and the release preventing wall 4124, there is no potential problem that the ring R may drop from the ring-holding portion 412.

Figure 27:
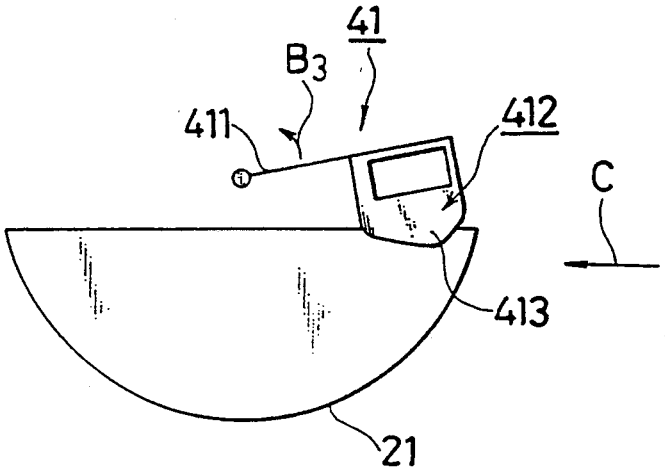
FIG. 27 is a schematic illustration of operation in which the arm depicted in FIG. 20 is used.
Figure 28:
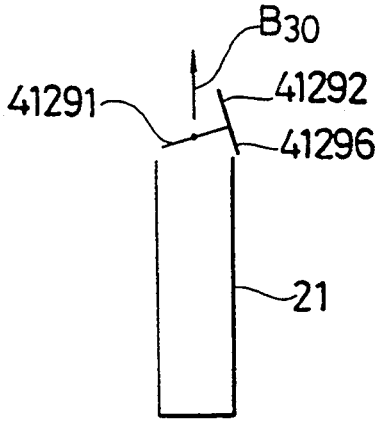
FIG. 28 is a schematic illustration of operation in which the arm depicted in FIG. 20 is used.

As the arm 41 continues to turn, the ring-holding portion 412 eventually moves away from the upper edge of the tank 21 as shown in FIG. 27 so that the engaging piece 41296 becomes no longer in contact with the inner wall of the tank 21. There is hence no external restraint to the tilted portion 4129. As is shown in FIG. 28, the tilted portion 4129 is again tilted by the biasing force of the spring 4128 and the ring R slides down from the upper surface of the tilted turnable portion 41291 toward the tank 22 of the next stage. FIG. 28 illustrates the state after the ring R has slid down into the tank 22.

Figure 29:
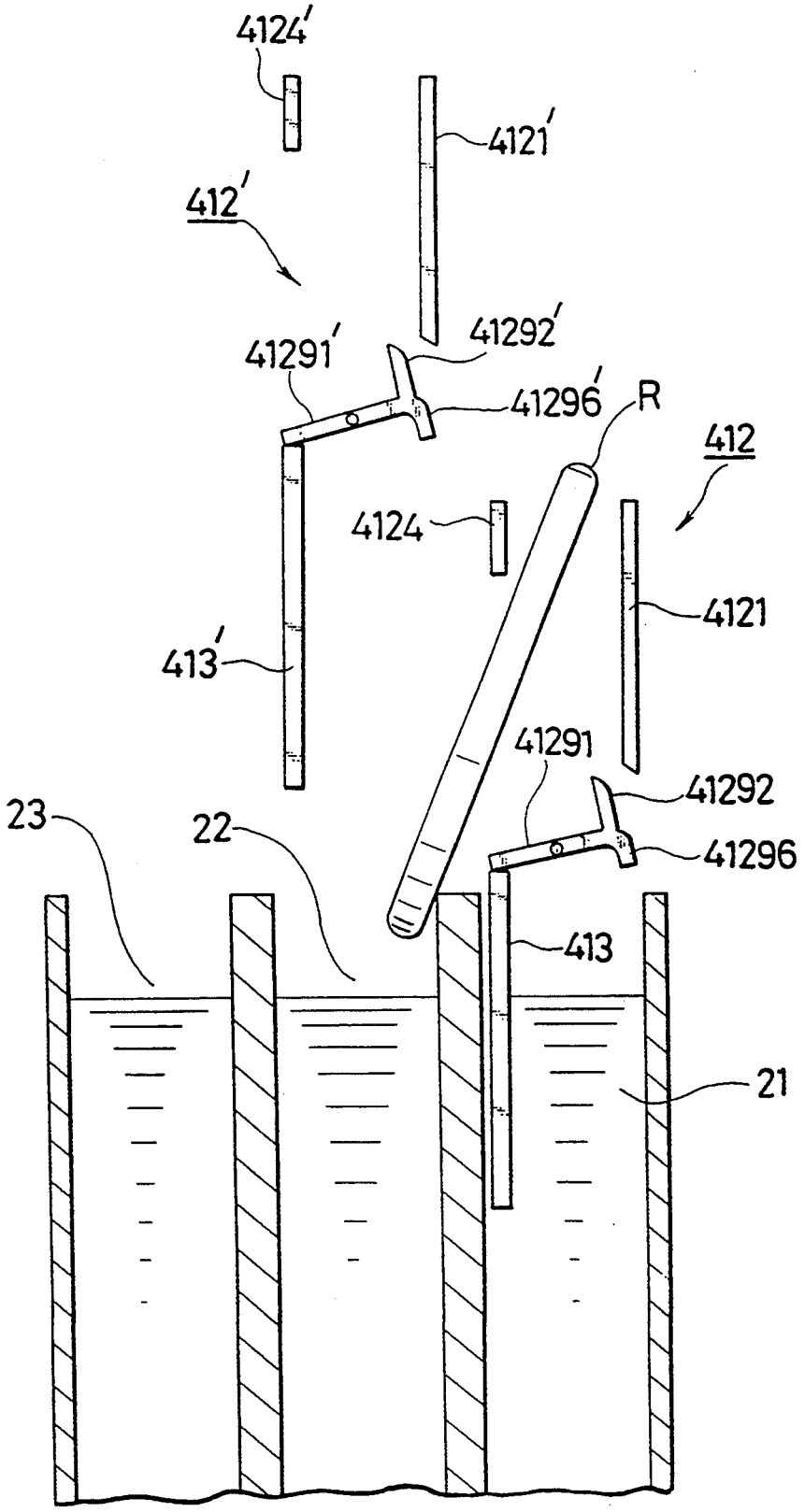
FIG. 29 is a schematic illustration of operation upon dropping a ring.

FIG. 29 illustrates the state when the ring R is about to slide down into the tank 22. Elements identical to the corresponding elements shown in FIGS. 20 and 21 are identified by like reference numerals. Incidentally, numeral 412' indicates a ring-holding portion of an arm 41' which is associated with the tank 22 of the next stage. The ring-holding portion 412' has the same structure as the ring-holding portion 412.

The ring R slides down on the tilted surface of the turnable portion 41291. When the ring 8 is about to plunge into the tank 22, there is the potential problem that the ring R may jump over the tank 22 and may enter the tank 23 by its own power. If the position of the adjacent arm 41' is adjusted so that its guide wall 413' assumes the position indicated in FIG. 29 at the time point of the falling of the ring R, the ring 5 is prevented by the guide wall 413' from jumping over and is allowed to fall into the tank 22 without failure.

Figure 5:
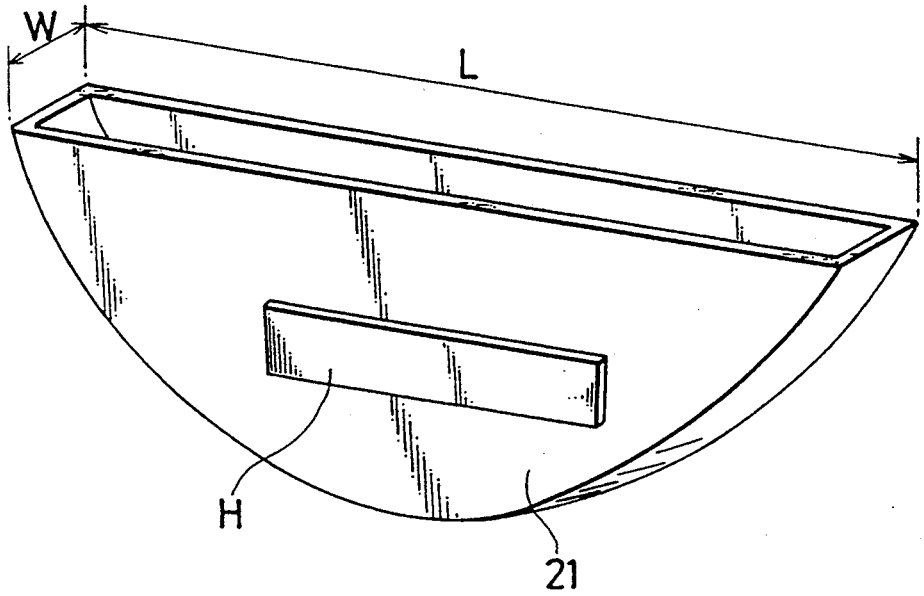
FIG. 5 is a perspective view of one of the tanks shown in FIG. 3.

In each of the preceding embodiments, the tanks 21,22,23 are each provided by way of example with the heater pad H as shown in FIG. 5. It is possible to protect each tank from being heated without any processing solution therein, provided that a heating compartment is formed in a lower part of the tank and the processing solution is heated in the heating compartment. The structure of such a tank will be described with reference to FIGS. 30 and 31.

Figure 30:
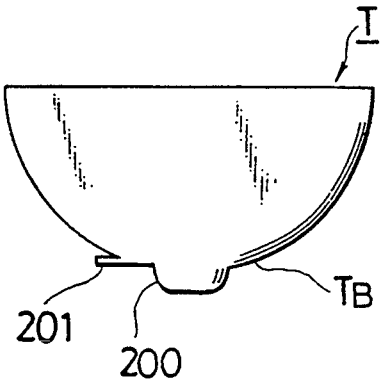
FIG. 30 is an overall construction diagram of a tank which is different from that illustrated in FIG. 5.

Referring first to FIG. 30, there are shown a tank T, a bottom wall $T_B$ of the tank T, a heating compartment 200 arranged underneath the bottom wall $T_B$ of the tank T, and a drain port 201 for draining the processing solution from the tank T. Details of the heating compartment 200 will next be described based on FIG. 31.

Figure 31:
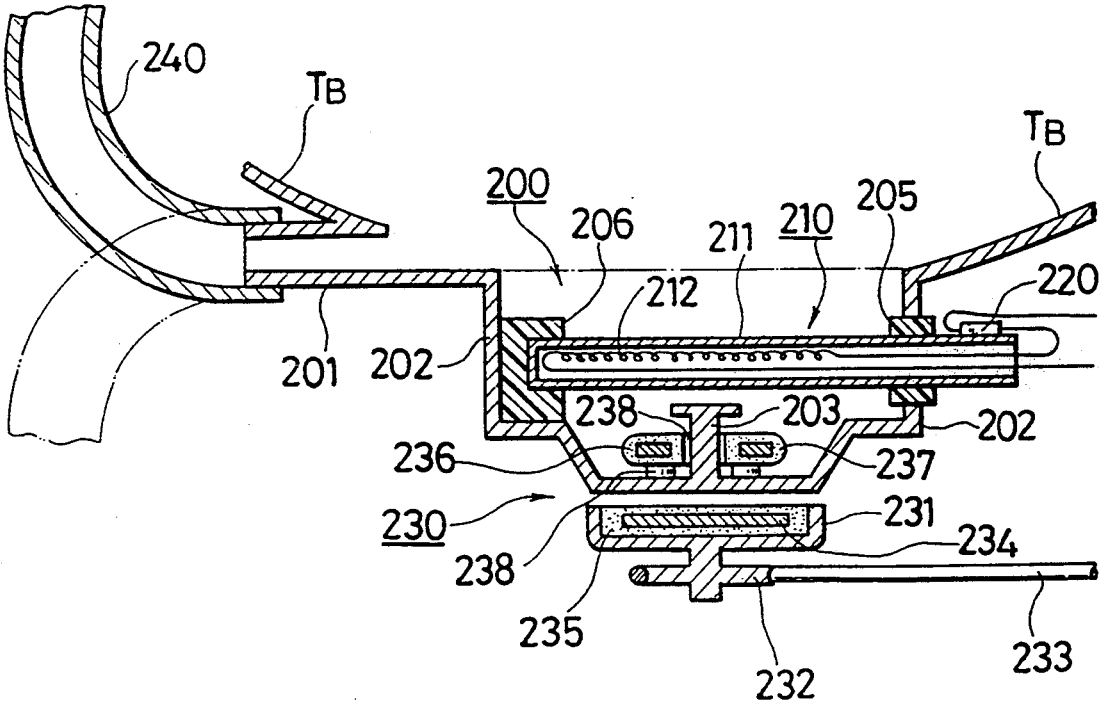
FIG. 31 is a cross-sectional view of a heating compartment of the tank shown in FIG. 30.

In FIG. 31, elements identical to the corresponding elements shown in FIG. 30 are identified by like reference numerals. Designated at numeral 202 is a wall, which forms the heating compartment 200 and is formed in continuation with the bottom wall $T_B$. By the formation of the wall 202, the heating compartment 200 is constructed underneath the bottom wall $T_B$ of the tank T in communication with a lower part of the tank T. Numeral 203 indicates a shaft extending into the heating compartment 202 from the wall 202 which forms a bottom wall of the heating compartment 200.

Designated at numeral 210 is a heater inserted in the heating compartment 200. This heater is formed, for example, of a stainless steel tube 211 and a heating wire 211 disposed inside the tube. By feeding an electric current through the heating wire 212, the heating wire is caused to give off heat so that the tube 211 is heated. Numeral 220 indicates a thermal fuse, which is connected in series with the heater 210 (i.e., the heating wire 212) and is disposed on the tube 211 of the heater 210.

There are also shown an agitator 230 for stirring the processing solution in the tank T, a magnet support 231, a pulley 232 mounted integrally with the magnet support 231, and a belt 233. The belt 233 is mounted extending between the pulley 232 and another pulley which is not illustrated. When the unillustrated pulley rotated by a drive source (not shown), the rotation is transmitted to the pulley 232 via the belt 233 so that the magnet support 231 is rotated. Numeral 234 designates a magnet, whereas numeral 235 indicates a synthetic resin layer holding the magnet 234 in the magnet support 231.

Also shown are a magnetic body 236 such as an iron piece and a disk-shaped synthetic resin layer 237 with the magnetic body 236 held therein. The synthetic resin layer 237 is rotatably mounted on the shaft 203 via a bearing 238. Another bearing 238 is disposed between the synthetic resin layer 237 and the wall 202 forming the bottom wall of the heating compartment 200. It is to be noted that these bearings 238 are not absolutely needed. Any construction can be used insofar as the synthetic resin layer 237 is rotatable relative to the shaft 203.

Designated at numeral 205 is a rubber bush which seals a portion of the wall 202, through which portion the heater 210 extends, and also supports one end of the heater 210. Numeral 206 indicates a holder which supports the heater at an opposite and thereof. The heater 210 is fixed and supported in the heating compartment 200 by the rubber bush 205 and the holder 206.

Numeral 201 indicates a drain port for the processing solution, which is bored through the bottom wall $T_B$ at substantially the same level (height) as a lowermost portion of the bottom wall $T_B$. This level is indicated by an alternate long and short dash line in the drawing. Designated at numeral 240 is a drain pipe, such as a hose, fitted on the drain port 201. The drain pipe 240 is normally bent upright and held by an unillustrated latch as shown in the drawing. Upon draining the processing solution, the drain pipe 240 is unlatched and is suspended downwardly as indicated by alternate long and short dash lines, whereby the processing solution is externally drained through the drain port 201.

A description will next be made of the manner of use of this tank T. Upon conducting processing for development, each tank T is filled with a predetermined processing solution to a level as needed. At this time, the heating compartment 200 is obviously filled with the processing solution. While the development processing is carried out, an electric current is fed through the heater 210 and the thermal fuse 220 to heat the heater 210 so that the processing solution is maintained at a predetermined temperature. The processing solution is also stirred by the agitator 230, whereby the film F under processing is always kept in contact with the fresh processing solution.

When this development processing is repeated, the processing solution eventually deteriorates. It is therefore necessary to replace the processing solution by fresh one. To do this, an operator unlatches the drain pipe 240 and suspends it as indicated by the alternate long and short dash lines in the drawing. As a result, the processing solution is drained out of the tank T through the drain port 201. In this case, owing to the positional relationship between the drain port 201 and the heating compartment 200 (that the heating compartment 200 is located below the level of the drain port 201), the old processing solution is allowed to remain in the heating compartment 200 as high as the level indicated by the alternate long and short dash line in the drawing.

No problem will arise if a fresh supply of the processing solution is charged immediately in this state. If the development processing is once suspended without charging the processing solution and development processing is conducted again after the lapse of some hours or days, there is the tendency that the power supply would be turned on to conduct development processing without remembering the need for charging a fresh supply of processing solution. In this case, conventional tanks involve the potential danger of occurrence of a fire because the heater 210 may be overheated as mentioned above. According to the construction of the tank T, however, the processing solution still remains in the heating compartment 200 so that even if the heater 210 is heated, the heat is transferred to the processing solution still remaining in the heating compartment and the heater 210 is not overheated.

If the automated development processor is left over in this state for a considerable time, the temperature of the processing solution and that of the tube 211 of the heater arise. It is here that the thermal fuse 220 is actuated for the first time to cut off the series circuit and hence to stop feeding an electric current to the heater 210. This can surely avoid heating of an empty tank without remembering the need for charging a processing solution.

In each of the above-described embodiments, the number of tank(s) for the developer, the number of tank(s) for the fixer, the fixed positions of the arms relative to the rotary shaft, the revolution speed of the motor, and the like can be chosen suitably depending on developing and fixing conditions. Further, the upper compartment of the housing can be used as a dark room upon fitting the X-ray film in the ring. It is not absolutely necessary to provide each arm with the guide wall. The guide walls can however be omitted, provided that a wall defining a hole through which a ring is allowed to pass is arranged on an upper end of each tank at a position where the ring is thrown into the tank.

What is claimed is:

1. An automated development processor for an exposed dental X-ray film, said processor having a plurality of tanks filled with processing solutions, respectively, and arranged in parallel with one another so that development processing of the exposed dental X-ray film is conducted by successively throwing into the tanks a ring with the exposed dental X-ray film mounted thereon, comprising:

a rotary shaft whose axis extends in the same direction as the direction of the arrangement of the individual tanks; and arms fixed, in registration with said respective tanks, on said rotary shaft so that said arms are movable in the corresponding tanks;

wherein each of said arms comprises a fixed portion secured on said rotary shaft and a ring-holding portion arranged on a free end of said fixed portion, and said ring-holding portion defines a space for holding said ring therein and comprises a bottom wall for supporting said ring in said space, a first opening for receiving therethrough said ring, which is located in the corresponding processing solution, into said space as said corresponding arm is moving, a second opening for releasing said ring from said space into the adjacent tank or where said arm is associated with the last tank, releasing said ring out of said space, and means for preventing release of said ring through said second opening as said ring-holding portion is moving in the corresponding tank.

2. An automated development processor according to claim 1, wherein said bottom portion is tilted toward the adjacent tank or where said bottom portion is associated with said last tank, in a direction away from said last tank, and said release preventing means comprises a release preventing wall defining said first opening and said second opening and a plate member for closing at least a part of said second opening.

3. An automated development processor according to claim 2, wherein said plate member is a door which is arranged turnably by its own weight about an axis.

4. An automated development processor according to claim 2, wherein said plate member is a slide plate which is arranged slidably by its own weight along a plane of said second opening.

5. An automated development processor according to claim 2, wherein said plate member is a slide plate which closes a part of said second opening under action of a spring but cancels said closure upon engagement with an engaging piece disposed on one end of said associate tank, said one end being the end from which said ring-holding portion moves away from said associated tank.

6. An automated development processor according to claim 1, wherein said bottom portion is constructed of a turnable portion inclined by a spring toward said adjacent tank or where said bottom portion is associated with said last tank, in a direction away from said last tank and an engaging piece engageable with an inner wall of said corresponding tank to maintain said turnable portion horizontally against said action of said spring; and said release preventing means is a release preventing wall defining said first opening and said second opening.

7. An automated development processor according to claim 1, wherein each of said arms is provided at a location on its ring-holding portion with a guide wall, said location being on a side of the next tank or where said arm is associated with the last tank, on a side opposite to the preceding tank and also being on a rear side relative to the direction of movement of said ring-holding portion, wherein said ring released from the preceding tank is guided.

8. An automated development processor according to claim 1, wherein each of said tanks is provided with a heating compartment downwardly extending from said bottom portion, communicated with said tank and accommodating a heater therein.

9. An automated development processor according to claim 8, said heating compartment is provided with an agitator means for stirring the corresponding processing solution.

* * * * *